United States Patent [19]

Garside

[11] Patent Number: 4,513,582

[45] Date of Patent: Apr. 30, 1985

[54] EXPENDABLE REFRIGERATION CONTROL

[75] Inventor: David Garside, Rosemere, Canada

[73] Assignee: 128980 Canada Inc., Claire, Canada

[21] Appl. No.: 377,068

[22] Filed: May 11, 1982

[51] Int. Cl.[3] ..... F25B 41/04; F25B 19/00

[52] U.S. Cl. ..... 62/222; 62/231; 137/624.14

[58] Field of Search ..... 137/624.13, 624.14, 137/817, 821, 830; 62/222, 231, 514 R

[56] References Cited

U.S. PATENT DOCUMENTS

| | | | |
|---|---|---|---|
| 3,508,565 | 4/1970 | Strantz | 137/821 X |
| 3,942,518 | 3/1976 | Tenteris et al. | 137/624.14 |
| 4,041,725 | 8/1977 | Garside | 62/514 R X |

*Primary Examiner*—Harry B. Tanner

*Attorney, Agent, or Firm*—Alan Swabey; Robert Mitchell; Guy J. Houle

[57] ABSTRACT

A control for use with an expendable refrigeration system is disclosed which has particular use in refrigerated transport applications. The control is used to regulate the injection of refrigerant into the space to be refrigerated and provides an accurate means of precisely selecting a preferred ratio of "on" to "off" timing segments in each cycle and the number of complete cycles in a given time frame. In one embodiment of the invention, pneumatic pressures are used to power an oscillating device, the number of oscillations are counted to a selectable total. Attainment of the chosen total causes the counter to transmit a signal, which signal actuates the operator of a four-way valve. The switching of the valve provides the means to (a) open a liquid line valve to inject the refrigerant into the refrigerated space and (b) reset the counter, terminate the actuation signal and start the next cycle count. A time delay-on release device, itself capable of adjustment, is used to delay the return switching of the four-way valve, hence the duration of the "on" timing segment.

6 Claims, 7 Drawing Figures

EXPENDABLE REFRIGERATION CONTROL

BACKGROUND OF INVENTION (a) Field of the Invention

The present invention relates to an apparatus and method for controlling the opening and/or closing operation of a liquid valve dispensing liquid fed thereto from a reservoir, using the inherent gas pressure from the reservoir.

The present application particularly relates to a control system for a pressurized liquid gas reservoir incorporated in an expendable refrigerant refrigeration system. In such instance, the invention provides a control system which utilizes gas from the reservoir to control the flow of liquid from the reservoir in a series of cyclic injections.

(b) Description of Prior Art

The use of reservoir gas as a control media is well known as are cyclic control sequences used to achieve "pulsed" refrigerant injections. Applicant's U.S. Pat. No. 4,041,725 dated Aug. 16, 1977 discloses one method which makes use of two pressure actuated three-way valves, connected by gas lines damped by restrictors, such that the output of one addresses the actuation of the other to create a rythmic assymetrical oscillation which results in one "pulsed" injection of refrigerant for each full cycle of the control system.

The aforementioned prior art invention, in practical application, has proved to have but limited facility to vary the ratios of "on" to "off" timing. It has been found for instance, the adjustment of one restrictor affects both the "on" and the "off" durations and a normal maximum differential between the two cannot safely exceed a 5:1 ratio. Nor can the overall duration of a complete cycle be extended beyond about two minutes, without incurring the risk of hysteresis in the valve with consequential failure of the control function.

Working at or near the aforementioned limits of adjustment, requires a delicate, skilled, touch. Field calibration by unskilled operators is deemed all but impossible.

Although the control disclosed in U.S. Pat. No. 4,041,725 has a proven value when used in series with a temperature controller, by providing an extended response time so as to allow the temperature sensor a greater time to react to changed conditions and so avoid an overshoot (of refrigerant injected), it is deemed to have little practical worth as a selectable metering means.

A second problem and one common to most if not all controls used with expendable refrigeration systems, arises whenever the control set point is set, for whatever reason, below the existing cargo temperature. In these circumstances, the control, in seeking to reduce temperatures to that set point and needing to reduce a large cargo mass to achieve that purpose, will commence and continue to inject refrigerant at its maximum rated capacity. Generally, this action will rapidly exhaust the available refrigerant leaving the product without means of refrigeration for the balance of the journey.

SUMMARY OF INVENTION

It is therefore a prime aim of the present invention to overcome the aforementioned problems.

The present invention, by providing a means of control which is accurate and readily set or reset by even unskilled persons and by allowing precise definition of the ratio of "on" to "off" time through a ratio range of 1:1 to 99999:1, solves both control problems. This control permits accurate and adjustably definable metering of hourly inputs of refrigerant and the decision to fit a temperature sensing controller in series, is thus one of choice rather than practical necessity.

In one aspect of the present invention, there is provided an apparatus for controlling the opening and closing operation of a liquid flow valve dispensing liquid fed thereto from a reservoir, using the inherent gas pressure from the reservoir, comprising in combination: (a) an actuator operably connected to the flow valve for opening and closing the same; (b) valve means including operator mechanism, operably connected to the actuator for activating the same; and (c) control means for controlling the operation of the valve means, the control means comprising circuitry having at least one pressure operated oscillating pulse generator unit and a counting means operably connected to count the oscillations and thereby control the valve means operator mechanism.

In a further aspect of the present invention, there is provided a method of controlling the opening and/or closing operation of a liquid flow valve dispensing liquid fed thereto from a reservoir, using the inherent gas pressure from the reservoir, comprising the step of: passing the gas through circuitry interconnecting the reservoir with actuator means controlling operation of said flow valve, the circuitry having at least one pressure operated oscillating pulse generator unit and pulse counting means controlling operation of said actuator means whereby the gas moves the actuator to cause opening and/or closing of the flow valve, the time duration of the opening and/or closing being controlled by the setting of the counting means.

In a further aspect, the present invention provides in a refrigeration unit including a pressurized liquid gas reservoir and a flow valve for releasing the liquid gas, a control system for metering the flow. The unit comprising a first gas line extending from the liquified gas reservoir. A first liquid line extending from the liquified gas reservoir connecting to the liquid flow valve. A first branch line from the first gas line connecting to the inlet port of a four-way valve. Such valve having one working port connected by a second gas line to one chamber of a double acting piston actuator, itself connected mechanically to control the liquid flow valve, and a second working port connected by a third gas line to the other chamber of the double acting piston actuator and an exhaust port free to discharge to atmosphere. A second branch line extending from the first gas line connects to a pressure operated oscillating pulse generator unit. A counting device adapted to pass a pneumatic signal and having a pneumatic reset means is connected by a third branch line to the first gas line, by a fourth gas line to the oscillating pulse generator unit and by a fifth gas line to the operator mechanism of the four-way valve. A fourth branch line from the first gas line is connected to a second oscillating pulse generator unit. A second counter is connected by a first branch line from the second gas line, by a sixth gas line to the reset means of the first counter and by a seventh gas line to the second oscillating pulse generator unit. A first branch line from the third gas line is connected to the reset means of the second counter. Alternatively, a first branch line from the sixth gas line is connected to the reset means of the second counter.

In another embodiment according to the invention, the four-way valve is equipped with an adjustable time delay-on release device. The first branch line from the second gas line is connected to the reset means of the first counter and the second counter with its oscillating pulse generator unit and their attendant connections, including the first branch line from the third gas line, are dispensed with.

In yet another embodiment, the system includes a controller connected in the first gas line, positioned intermediate the junctions of the first and second branch lines, which controller is activated by a remote located temperature sensor. Such controller may of course be used with either of the aforementioned embodiments.

BRIEF DESCRIPTION OF DRAWINGS

The invention is illustrated by way of example in the accompanying drawings wherein.

DESCRIPTION OF PREFERRED EMBODIMENTS

Referring now in detail to the drawings.

Figure 1:
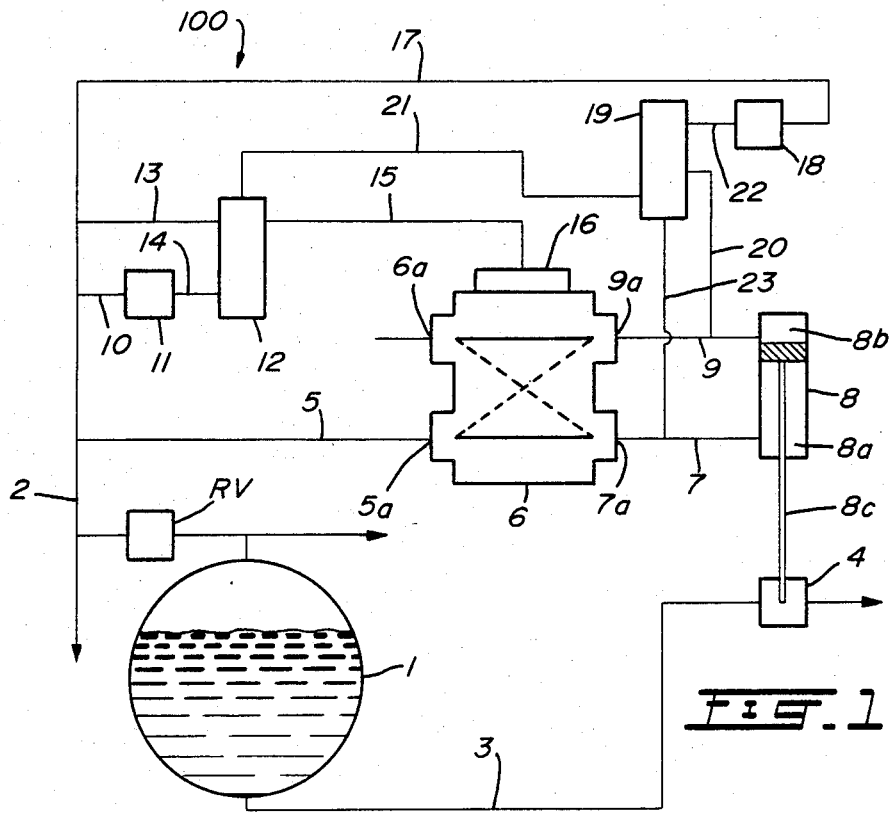
FIG. 1 is a schematic diagram illustrating one embodiment according to the present invention showing a control system, such as for a refrigeration unit, including a pressurized liquified gas reservoir and a piston actuated flow valve, for releasing the liquified gas.

In FIG. 1, an arrangement 100 is shown, such comprising: a pressurized liquified gas reservoir 1 having a gas line 2 and a liquid line 3. A reducing valve RV is seen positioned in gas line 2 to reduce the pressure for the control media and a liquid flow valve 4 is positioned in the liquid line 3.

As further seen in FIG. 1, a gas branch line 5 is connected to the inlet port 5*a* of a four-way valve 6 having one working port 7*a* connected by a gas line 7 to one chamber 8*a* of a double acting piston actuator 8 and a second working port 9*a* connected by a gas line 9 to the other chamber 8*b* of the double acting piston actuator 8.

Valve 6 includes an exhaust port 6*a* which is open to atmosphere. The piston actuator 8 is, as seen, mechanically linked to operate the liquid flow valve 4 by piston rod 8*c*.

A branch line 10 is connected to a pressure operated oscillating pulse generator unit 11 constructed to create a pressure pulse at regular intervals, for example once each second. A pulse counter 12 designed to count up or down from 0 to a predetermined but adjustable number, and on reaching that number, or zero stop the count and pass a pressure signal, is connected to the supply gas line 2 by a branch line 13, by a gas line 14 to the oscillating pulse generator unit 11 and by a gas line 15 to the operator 16 of the four-way valve 6.

A branch line 17 connects supply gas line 2 to a second pressure operated oscillating pulse generator unit 18. A second pulse counter 19 is connected to the gas line 9 by a branch line 20, by a gas line 21 to the reset means of the first counter 12 and by a gas line 22 to the second oscillating pulse generator unit. A branch line 23 connects gas line 7 or alternatively gas line 21, to the reset means of the second counter 19.

In operation, gas from the reservoir 1 is supplied through gas line 2 reducing valve RV, the branch line 5 the normally set "released" four-way valve 6 and gas line 7 to the lower chamber of the double acting piston actuator 8. This pressure holds the piston back and the liquid line valve 4 in the closed position. Both oscillating pulse generator units 11 and 18 are continuously fed pressure signals through their respective branch lines 10 and 17.

Assuming a start up position without signal pressure in the gas line 21 the first counter 12 will commence "or continue with" its count. Any signal pressure in branch line 13 will be held in check at the first counter 12. On reaching its predetermined total count, the counter 12 will stop and the signal pressure from branch line 13 will pass to gas line 15 and the operator 16 of the four-way valve 6. Valve 6 is now actuated; gas line 7 is exhausted; gas line 9 is pressurized; the piston of actuator 8 moves downwardly; the liquid valve 4 is opened; if branch line 23 is connected to gas line 7, the signal pressure in branch line 23 is exhausted; if branch line 23 is connected to gas line 21, it is already exhausted; the second counter 19 starts counting. A pressure signal in gas line 9 and branch line 20 is held checked at the second counter 19. On reaching its predetermined count, the counter 19 will stop and the signal pressure from branch line 20 will pass to gas line 21 and the reset port of the first counter 12; and in the alternate circuit, through branch line 23 to the reset means of the second counter.

The count of the first counter 12 is now set to zero, in the alternate circuit the second counter likewise is reset, closing the connection between gas line 15 and branch line 13 and in the alternate circuit between branch line 20 and gas line 21. Gas line 15 exhausts through the first counter bleedport, and in the alternate circuit gas line 21 extends through the second counter bleedport, and the operator 16 releases and restores the four-way valve 6 to its normal position. In the alternate circuit, gas line 21 will exhaust through the second counter bleedport.

As valve 6 reverts to normal, gas line 7 is pressurized; gas line 9 is exhausted; the piston of actuator 8 moves upwardly; the liquid valve 4 is closed; if branch line 23 is connected to gas line 9, a pressure signal is transmitted through branch line 23 to reset the second counter 19; the pressure signal in branch line 20 exhausts, the signal in gas line 21 exhausts through the second counter bleedport; the count of the first counter 12 commences and the cycle starts over.

Figure 2:
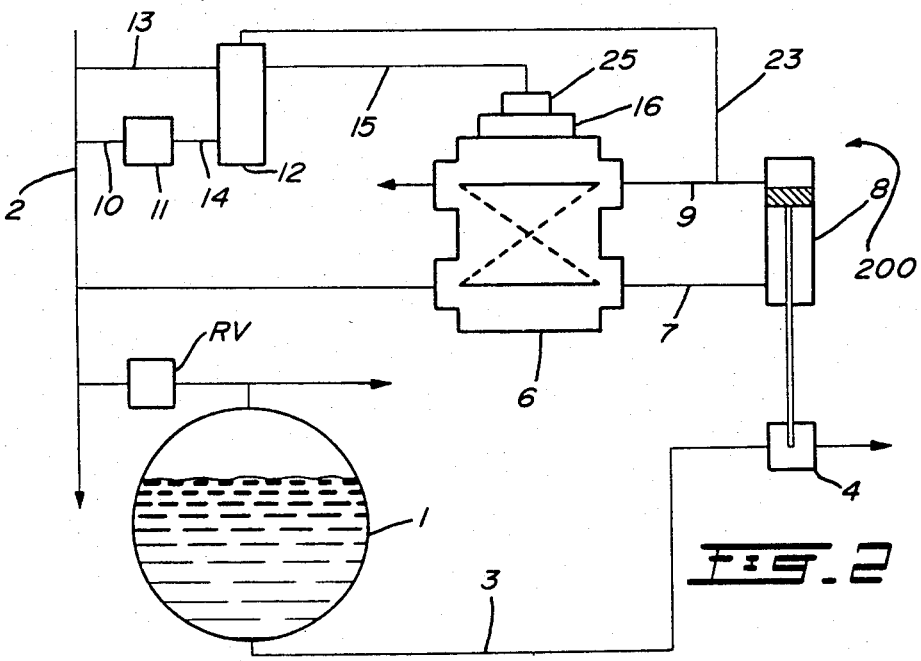
FIG. 2 is a schematic diagram illustrating a second embodiment according to the present invention.

Referring now to FIG. 2 showing arrangement 200. The circuit is as shown in FIG. 1 through to gas line 15. Gas line 15 is now connected to operator 16 through a time delay-on release device 25 which may be of fixed or variable type, if the latter, it may conveniently be adjustable through a range of 1 to 60 seconds. Branch line 23 from gas line 9 is connected to the reset of the counter 12.

In operation, gas flow and pressure application is made through to the actuating stage of valve 6, as in the first embodiment. As valve 6 switches, gas line 9 is pressurized and a signal transmitted through branch line 23 to reset the counter 12 to the 0 count position; the piston of actuator 8 moves upwardly and valve 4 is opened.

Resetting the counter to zero serves to check the source of the pressure signal holding the operator 16; gas line 15 is evacuated through the counter bleedport.

Release of the operator 16 is delayed by the action of the time delay-on release device 25. Until the operator 16 is released, valve 6 remains actuated; the piston of actuator 8 stays down; the liquid valve 4 opens; gas line 9 and branch line 23 are under pressure and the pressure in branch line 23 holds the counter at zero.

When the delay device 25 expires, valve 6 is released; gas line 9 and branch line 23 are evacuated; gas line 7 is pressurized; the piston of actuator 8 moves down; the liquid line valve 4 is closed; the count of counter 12 is restarted and the cycle starts over.

Figure 3:
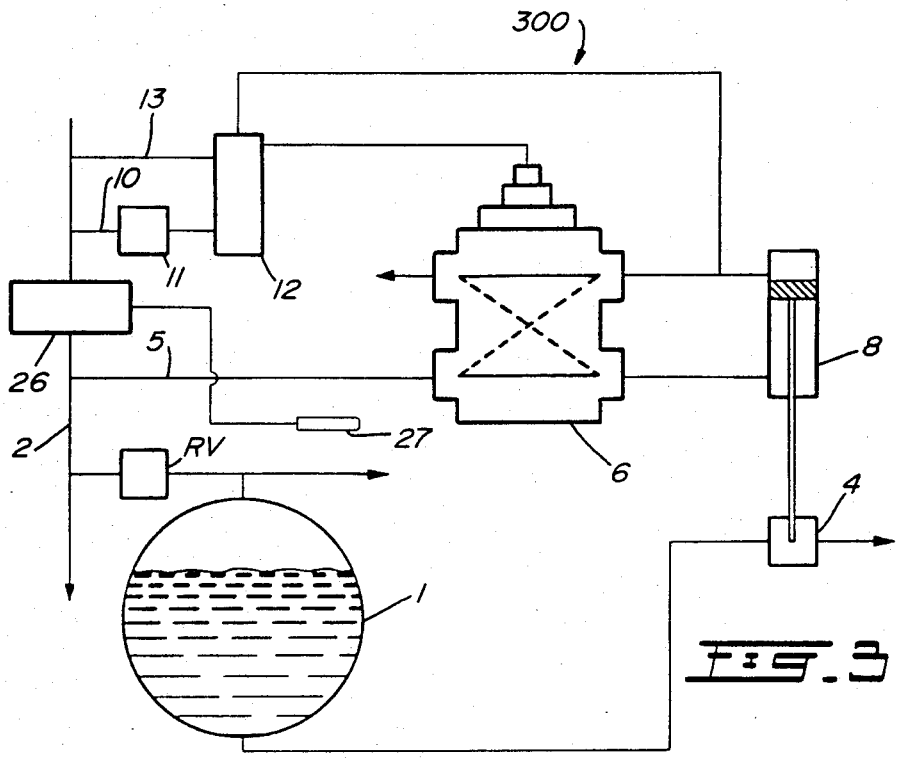
FIG. 3 is a schematic diagram illustrating a third embodiment according to the present invention, being similar to that shown in FIG. 2.
Figure 1A:
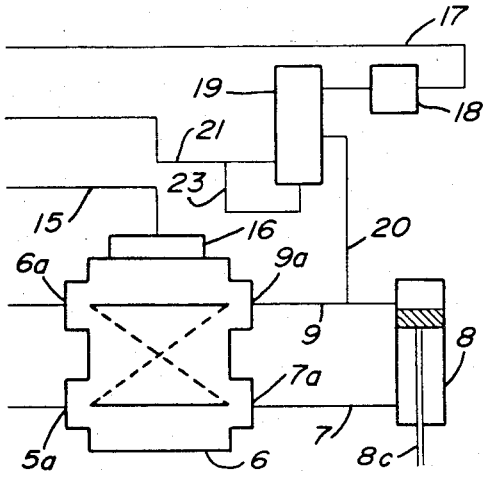
FIG. 1A is a part view of the circuit of FIG. 1 showing a modification thereto.

Referring now to FIG. 3 and arrangement 300 being similar to that of arrangement 200, representing a third embodiment of the invention. A temperature responsive controller unit 26 is added in gas line 2 intermediate the junctions of branch line 5 and branch line 10. The controller unit 26 is connected by a signal transmitter/temperature sensor 27 remotely situated and responsive to the temperature of a controlled temperature zone.

In operation, the controller 26 is activated by a signal received from the transmitter/which signal is itself sent in response to a sensed temperature increase by the sensor 27. The controller 26 on being activated turns on the control section of the pulse circuit which involves transmission of pressure signals through branch lines 10 and 13 and 17 where applicable. For so long as the excess temperature persists, the controller will remain "charged" and cycling, through the on/off pulse modes, will repeat over. When the cooling demand is met, the controller will turn off and the on/off pulse cycle will be terminated.

Figure 4:
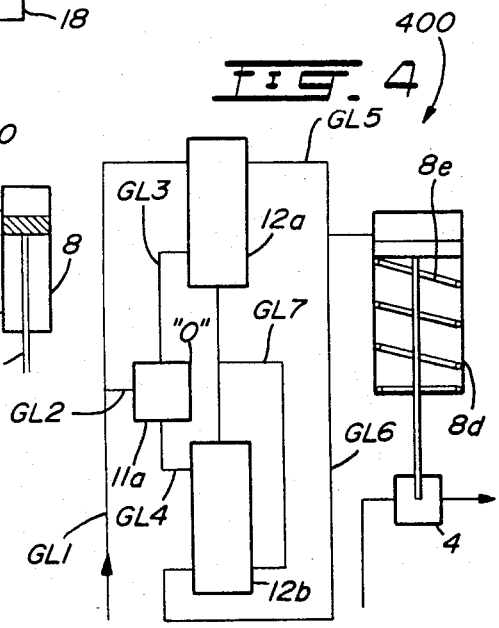
FIG. 4 is a schematic diagram illustrating a fourth embodiment according to the present invention.

Referring now to FIG. 4 and arrangement 400 representing a further embodiment of the present invention. This embodiment in fact, along with those shown in FIGS. 5 and 6 discussed hereinafter, represent the invention in its simplest basic form. Referring to FIG. 4, the embodiment utilizes only one oscillating pulse generator unit 11*a*, two counters respectively 12*a* and 12*b* and an actuator 8*d*, interconnected by lines described hereafter.

In operation, counter 12*a* is set for example at 60 seconds and counter 12*b* at for example 10 seconds. On supply of gas through GL 1 and GL 2 oscillating pulse generator unit "0" commences oscillating and counter 12*a* commences counting. Upon a count of 60 seconds, counter 12*a* stops counting and passes signal gas via GL 5 and GL 6 to (i) drive down the actuator piston of actuator 8*d* against spring 8*e;* (ii) supply gas to counter 12*b;* and (iii) start the count of counter 12*b*. Upon a count of 10 seconds, counter 12*b* stops counting and passes signal gas simultaneously to the reset control of counters 12*a* and 12*b*, both counters set to zero, gas in GL 7; GL 6 and GL 5 and the piston chamber of the actuator 8*d* is vented to: (i) cause the piston of actuator 8*d* to return by aid of the spring 8*e;* and (ii) complete the cycle and restart the count of counter 12*a*.

One of the most simple and practical arrangements according to the present invention comprises an assembly of the following components to control the flow of a liquid refrigerant:

(a) a gas and liquid refrigerant storage;

(b) a pressure activated pulse generator set to oscillate for example at one pulse per second;

(c) a counting (down) means having one inlet, two outlets, a reset and a sense connecting port and combining a switching means, responsive to a count determined, connecting the supply port to the outlet ports and the outlet ports to a bleed port;

(d) a pressure operated, spring return, piston actuator; and (e) a liquid valve.

Alternatively, a gas switching valve may be used in series with the piston actuator to allow substitution of the single acting piston unit by a double acting piston unit.

The counter is designed so as to allow the setting of a number within the limits of its range and upon start up, count the number of the oscillations of the pulse generator, deducting one from the counter set number upon receipt of each pulse and, upon descent to a first set value, pass a signal from the supply port to the first outlet port, and upon reaching a count of zero, pass a second signal from the supply port to the second outlet port.

Figure 5:
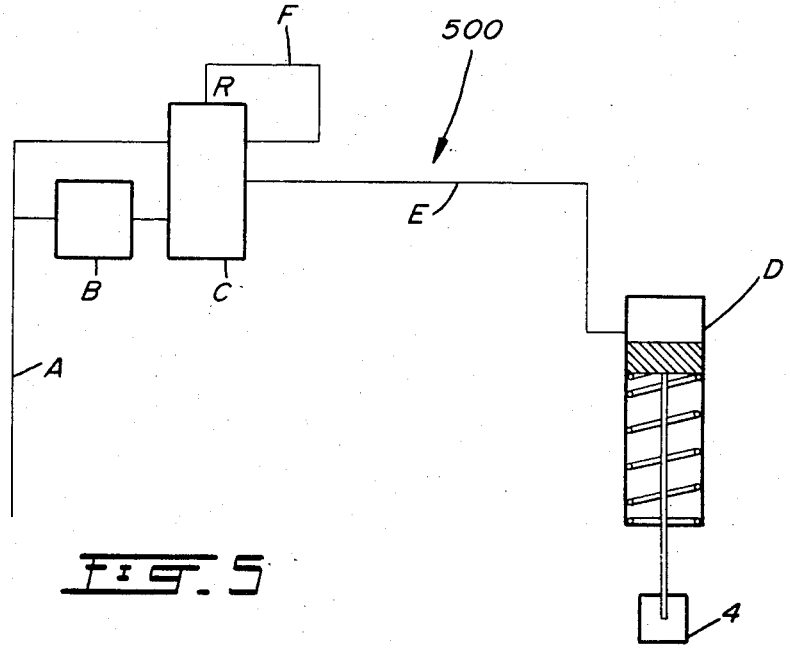
FIG. 5 is a schematic diagram illustrating a fifth embodiment according to the present invention.

Referring now to FIG. 5 and arrangement 500. A gas line A connects the oscillating pulse generator unit B and the counter C to a gas reservoir (not shown). The first outlet of the counter C is connected to the inlet port of the actuator D by a line E and the second outlet of the counter C is connected to its own reset means R by line F.

In operation, with gas supplied to line A, the oscillating pulse generator unit B commences to oscillate and the counter C begins counting the number of oscillations, deducting one for each pulse counted from the preset start up number of the counter.

When the count descends to a number corresponding to the number which is preset to activate the first switch of the counting means C, a signal is passed through the first outlet port through gas line E to the upper chamber of the actuator D, driving down the piston and causing the liquid valve 4 to open.

Upon descent of the count to zero, a second signal, this time from the supply port to the second outlet port, is passed to gas line F and the counter reset means.

The counter now resets to its original start up number and the signal from the supply port to the two outlet ports is interrupted. Simultaneously, the two outlet ports, the gas line E and F and the gas chamber of the actuator D are vented to atmosphere via the bleedport of the counter C. The spring return of the actuator D returns the piston to the top of its stroke and liquid valve 4 is closed. The cycle now repeats.

Figure 6:
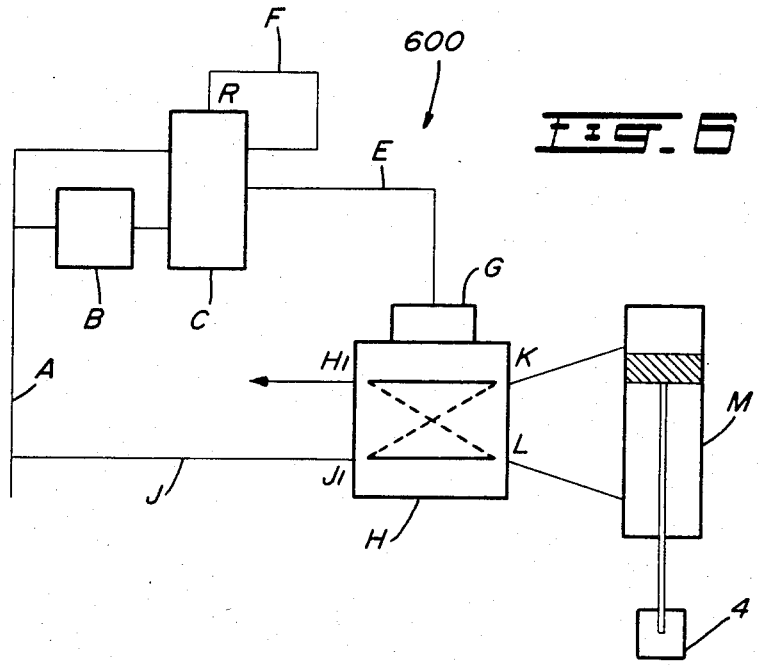
FIG. 6 is a schematic diagram illustrating a sixth embodiment according to the present invention.

Referring to FIG. 6 and arrangement 600. Such is noted to include items B, C, E, F and R as in arrangement 500. As seen, gas line E connects to the operator G of a four-way valve H. The four-way valve H has a supply port J1 connected by a gas line J to gas line A, two outlet ports K and L, and an exhaust port H1. In this normal position of valve H, supply port J1 connects to port L and exhaust port H1 connects to port K. Outlet L is connected to the lower chamber of the piston actuator M and the outlet K is connected to the upper chamber of the piston actuator M.

In operation, the control sequence is as in FIG. 1 except that a pressure signal in gas line E now activates the operator G of the four-way valve H and the switching of that valve reverses the gas flow to the actuator M. Collapse of the signal pressure in gas line E restores the original direction of flow.

From the foregoing and the latter in particular, for reason of simplicity, it will be seen there is provided a much improved apparatus for, for example, controlling the operation of a liquid valve or the like dispensing liquid, such as $CO_2$, fed thereto from a reservoir or the like and which utilizes the inherent gas pressure from the reservoir.

It is visualized there are other applications for the present apparatus outside of the refrigeration system field, to which it particularly relates.

I claim:

1. An apparatus for controlling the opening and closing operation of a refrigerant flow valve dispensing refrigerant fluid fed thereto from a reservoir, using the inherent gas pressure from the reservoir, comprising in combination:

(a) an actuator operably connected to said flow valve for opening and closing the same;

(b) valve means including operator mechanism, operably connected to said actuator for activating the same; and (c) control means for controlling the operation of said valve means, said control means comprising circuitry having at least one pressure operated oscillating pulse generator unit and a counting means operably connected to count the oscillations and thereby control the valve means operator mechanism, whereby facility to vary the ratios of "on" to "off" timing within a ratio range of 1:1 to 99999:1 are provided, normal maximum differential between the "on" and "off" durations may exceed a 5:1 ratio and the overall duration of a complete cycle may be extended beyond about two minutes without incurring the risk of hysteresis in the valve with consequential failure of the control function.

2. An apparatus as defined in claim 1, wherein said actuator comprises a double acting cylinder device.

3. An apparatus as defined in claim 1, wherein said valve means comprises a four-way valve.

4. An apparatus as defined in claim 1, wherein said counting means may be set to count a predetermined number of oscillations of said oscillating pulse generator unit.

5. An apparatus for controlling the opening and closing operation of a refrigerant flow valve dispensing fluid fed thereto from a reservoir, using the inherent gas pressure from the reservoir, comprising in combination:

(a) an actuator operably connected to said flow valve for operating the same; and (b) control means operably connected to said actuator for directly activating said actuator, said control means comprising circuitry having at least one pressure operated oscillating pulse generator unit and a counting means operably connected to count the oscillations, whereby facility to vary the ratios of "on" to "off" timing within a ratio range of 1:1 to 99999:1 are provided, normal maximum differential between the "on" and "off" durations may exceed a 5:1 ratio and the overall duration of a complete cycle may be extended beyond about two minutes without incurring the risk of hysteresis in the valve with consequential failure of the control function.

6. A method of controlling the opening and/or closing operation of a refrigerant flow valve dispensing fluid fed thereto from a reservoir, using the inherent gas pressure from the reservoir, comprising the step of: passing said gas through circuitry interconnecting said reservoir with actuator means controlling operation of said flow valve, said circuitry having at least one pressure operated oscillating pulse generator unit and pulse counting means controlling operation of said actuator means whereby said gas moves said actuator to cause opening and/or closing of said flow valve, the time duration of the opening and/or closing being controlled by the setting of the counting means, whereby facility to vary the ratios of "on" to "off" timing within a ratio range of 1:1 to 99999:1 are provided, normal maximum differential between the "on" and "off" durations may exceed a 5:1 ratio and the overall duration of a complete cycle may be extended beyond about two minutes without incurring the risk of hysteresis in the valve with consequential failure of the control function.

* * * * *